US009388582B1

(12) United States Patent
Smythe

(10) Patent No.: US 9,388,582 B1
(45) Date of Patent: Jul. 12, 2016

(54) DRYWALL CORNER TRIM MATERIAL WITH ADHESIVE

(71) Applicant: Timothy Smythe, Bend, OR (US)

(72) Inventor: Timothy Smythe, Bend, OR (US)

(73) Assignee: CERTAINTEED GYPSUM AND CEILING MANUFACTURING, INC, Malvern, PA (US)

( * ) Notice: Subject to any disclaimer, the term of this patent is extended or adjusted under 35 U.S.C. 154(b) by 0 days.

(21) Appl. No.: 14/605,784

(22) Filed: Jan. 26, 2015

Related U.S. Application Data

(63) Continuation of application No. 14/174,704, filed on Feb. 6, 2014, now abandoned, which is a continuation of application No. 13/566,240, filed on Aug. 3, 2012, now abandoned, which is a continuation-in-part of application No. 12/414,431, filed on Mar. 30, 2009, now abandoned, which is a continuation-in-part of application No. 11/729,426, filed on Mar. 28, 2007, now abandoned.

(51) Int. Cl.

| | |
|---|---|
| ***E04F 13/06*** | (2006.01) |
| ***E04F 19/02*** | (2006.01) |
| *E04F 21/165* | (2006.01) |
| *E04F 21/00* | (2006.01) |

(52) U.S. Cl.
CPC ..... *E04F 13/068* (2013.01); *E04F 13/06* (2013.01); *E04F 19/022* (2013.01); *E04F 21/00* (2013.01); *E04F 21/165* (2013.01); *E04F 2013/063* (2013.01)

(58) Field of Classification Search
CPC ... E04F 13/06; E04F 2013/063; E04F 13/068; E04F 19/022; E04F 19/028; E04F 2013/066; E04F 21/00; E04F 21/165; E04F 19/064; E04F 13/0733
USPC ..... 52/255, 254, 287.1, 256; 428/77, 343, 428/346, 350; 156/308.6, 308.8, 324.4, 71, 156/83
See application file for complete search history.

(56) References Cited

U.S. PATENT DOCUMENTS

| | | | | | |
|---|---|---|---|---|---|
| 1,804,564 | A * | 5/1931 | McChesney | E04F 13/06 52/255 |
| 2,477,344 | A | 7/1949 | Neumann | 427/207.1 |
| 2,643,423 | A * | 6/1953 | Brendel | 52/255 |
| 2,768,096 | A | 10/1956 | Toulmin, Jr. | 428/350 |

(Continued)

FOREIGN PATENT DOCUMENTS

| | | | | |
|---|---|---|---|---|
| CA | 2520437 | A1 * | 10/1998 | E04F 13/06 |
| WO | WO 9714856 | A1 * | 4/1997 | B32B 29/00 |
| WO | WO 9844218 | A1 * | 10/1998 | E04F 13/06 |

*Primary Examiner* — Brian Glessner
*Assistant Examiner* — Babajide Demuren
(74) *Attorney, Agent, or Firm* — Abel Law Group, LLP; Alexander H. Plache

(57) ABSTRACT

A re-moistenable adhesive-coated drywall corner trim piece having an elongated semi-rigid core piece with a right and left flange, where the semi-rigid core piece has a centerline along which the flanges meet forming a hinge that can be bent and re-bent to any angle any number of times. The piece can also include a step running longitudinally along each of the flanges that can be located between the centerline and the flange edges so that the flanges change from a thicker portion toward the centerline to a thinner portion toward the edges making the piece boxable (capable of being wet mudded simultaneously on both sides without an intermediate drying step). Flanges can be curved slightly inward for perfect bonding.

15 Claims, 10 Drawing Sheets

(56) References Cited

U.S. PATENT DOCUMENTS

| | | | | | |
|---|---|---|---|---|---|
| 2,904,856 | A | | 9/1959 | Robinson | 52/255 |
| 3,078,182 | A | | 2/1963 | Crone, Jr. et al. | 428/353 |
| 3,341,105 | A | | 9/1967 | Curran | 229/132 |
| 3,391,509 | A | | 7/1968 | Fruman | 52/367 |
| 4,476,190 | A | | 10/1984 | Clarke et al. | 428/350 |
| 4,719,732 | A | * | 1/1988 | Bernard | 52/287.1 |
| 4,722,153 | A | | 2/1988 | Hardy | 52/255 |
| 4,833,002 | A | | 5/1989 | Sinclair | 428/195.1 |
| 4,977,718 | A | | 12/1990 | Hoffman, Sr. | 52/287.1 |
| 5,032,659 | A | | 7/1991 | Heidel | 527/300 |
| 5,045,374 | A | | 9/1991 | Tucker | 428/83 |
| 5,066,711 | A | | 11/1991 | Colon | |
| 5,258,429 | A | | 11/1993 | Kniewske et al. | 524/31 |
| 5,432,215 | A | | 7/1995 | Girg et al. | 524/28 |
| 5,531,050 | A | | 7/1996 | Stibolt et al. | 52/254 |
| 5,604,001 | A | | 2/1997 | Schold | |
| 5,613,335 | A | | 3/1997 | Rennich et al. | 52/255 |
| 5,904,016 | A | | 5/1999 | Koenig et al. | 52/255 |
| 6,073,406 | A | | 6/2000 | Kearney | 52/287.1 |
| 6,131,348 | A | | 10/2000 | Dunham | 52/287.1 |
| 6,148,573 | A | | 11/2000 | Smythe, Jr. | |
| 6,223,486 | B1 | * | 5/2001 | Dunham | 52/254 |
| D457,658 | S | | 5/2002 | Harel | |
| 6,447,872 | B1 | | 9/2002 | Larson | |
| 6,539,680 | B2 | | 4/2003 | Kunz | |
| 6,684,572 | B2 | * | 2/2004 | Homolka | E06B 7/28 49/462 |
| 6,722,092 | B2 | | 4/2004 | Kunz | |
| 6,779,313 | B2 | | 8/2004 | Smythe | |
| 6,894,095 | B2 | | 5/2005 | Russo et al. | 524/249 |
| 7,013,610 | B2 | | 3/2006 | Kunz | |
| 2002/0023400 | A1 | | 2/2002 | Smythe | |
| 2002/0035809 | A1 | | 3/2002 | Smythe | |
| 2003/0024188 | A1 | | 2/2003 | Smythe, Jr. | 52/255 |
| 2003/0033766 | A1 | | 2/2003 | Smythe | |
| 2004/0093816 | A1 | | 5/2004 | Smythe | |
| 2005/0028483 | A1 | | 2/2005 | Smythe | |
| 2005/0275828 | A1 | | 12/2005 | Behravesh et al. | 356/35.5 |
| 2006/0059809 | A1 | | 3/2006 | Smythe | 52/255 |
| 2006/0070324 | A1 | | 4/2006 | Daly, IV | 52/287.1 |
| 2006/0101746 | A1 | | 5/2006 | Smythe | 52/287.1 |
| 2006/0236626 | A1 | | 10/2006 | Smythe | |
| 2006/0283115 | A1 | | 12/2006 | Robertson | |
| 2011/0023392 | A1 | * | 2/2011 | Rosenthal et al. | 52/255 |

* cited by examiner

DRYWALL CORNER TRIM MATERIAL WITH ADHESIVE

This application is a continuation of application Ser. No. 14/174,704 filed Feb. 6, 2014 which was a continuation of application Ser. No. 13/566,240 filed Aug. 3, 2012, now abandoned, which was a continuation-in-part of application Ser. No. 12/414,431 filed Mar. 30, 2009, now abandoned which was a continuation-in-part of application Ser. No. 11/729,426 filed Mar. 28, 2007, now abandoned. application Ser. No. 14/174,704, 13/566,240, 12/414,431 and 11/729,426 are hereby incorporated by reference in their entireties.

BACKGROUND

1. Field of the Invention

The present invention relates generally to the field of drywall corner trim and more particularly to a drywall corner trim with adhesive.

2. Description of the Prior Art

Drywall corner trim is known in the art and has been used for years to finish interior and exterior corners in drywall construction. Classical corner beads were metal or vinyl strips with some sort of flange, through which mechanical fasteners are driven, and a bead running along the center of the material that allowed the corner to be finished with a mastic, like drywall mud.

Newer materials like flextrim pieces overcome many of the disadvantages of metal beads such as requiring large amounts of mud to finish, denting, rusting and other destructive effects. Flextrim usually contains a plastic center piece or base with paper flanges. The plastic may be grooved along the centerline to provide a flexible hinge where the flanges can be set at any angle. A typical flextrim product is described in U.S. Pat. No. 6,148,573. An improvement of the flextrim product is stepped flanges that make it boxable, that is that both flanges can be wet-mudded without mud overlapping from one flange to the other. Boxable flextrim is described in U.S. Pat. No. 6,779,313. U.S. Pat. Nos. 6,148,573 and 6,779,313 are hereby incorporated by reference.

It is known in the art that many corner bead and trim materials are difficult to apply using mechanical methods (for example screws, staples & nails) of attachment and are very susceptible to damage after application and finishing, usually due to impact or building movement. The damage can be in the form of cracked edges at the flange edge as the dried mud cracks during impact or building movement. This can result in the flange delaminating away from the wall surface.

To try to mitigate this type of damage associated with metal or vinyl corner bead, installers commonly use separate adhesives to better bond the corner bead material to the drywall corner, and they may apply mesh material over the flange edge of the corner bead after installation over which they apply their first layer of mud. The most commonly used adhesive is a spray-on type currently available. The mesh material is usually fiberglass, and may have a different adhesive applied to the wall-facing side.

It would be advantageous to have a corner trim material that decreases application time, decreases the need for expensive tools, decreases installer skill required to use drywall mud, and increases the finished bond integrity of the corner, as well as decreasing the susceptibility to damage. This material could be of the type that allows an installer to take a pre-cut piece of the material and stick it to the wall via a layer of adhesive already included on the wall facing side of the material. The adhesive can rapidly create a permanent bond between the corner trim material and the drywall. Drywall mud or other mastic material applied after the product is bonded to the wall can migrate through openings or holes in the flanges and create a secondary bond to the wall in a very strong, damage-resistant fashion. The moisture in the mud may also further activate the adhesive included on the wall side of the flextrim material if the adhesive is a water activated adhesive.

SUMMARY OF THE INVENTION

The present invention relates to a wet and stick drywall corner trim piece having a room-facing surface and a wall-facing surface that includes an elongated semi-rigid core piece with a right and left flange, where the semi-rigid core piece has a centerline where the flanges meet, and two outer edges running longitudinally along the piece. The piece also includes a step running longitudinally along each of the flanges that can be located between the centerline and the flange edges so that the flanges change from a thicker portion toward the centerline to a thinner portion toward the edges making the piece boxable (capable of being wet mudded simultaneously on both sides without an intermediate drying step). One or both of the flanges may be tapered from the thicker section running adjacent to the centerline of the product to the thinner section along the outside edge of the flange. The piece can also include a pattern of holes in the flanges typically in the part nearer the outside edge. An adhesive layer can be placed on the wall-facing side of the piece so that the piece can be attached to a drywall corner or seam, before mudding. The piece can have an outer layer prepared to accept and bond to mud, or layer of fibrous material like paper bonded to it that can be prepared to directly receive paint or texture. The holes can generally penetrate this layer. In addition, the piece can have an optional inner layer prepared to accept and bond to mud, or layer of fibrous material that can be the same or different paper as the outer layer. The holes can generally penetrate this layer also. A preferred adhesive is water-activated; however, any adhesive may be used. The preferred core material is high-impact plastic; however, any semi-rigid core material is within the scope of the present invention. The water-activated adhesive can have coloring to show wet and dry areas differently so that the installer can make sure it is entirely wet and hence thoroughly activated.

The water activated coated drywall trim piece described can be made with a sharp corner point, a bullnose crown known in the art, or a flexible hinge like flextrim known in the art or in any other nose configuration. The hinge can be formed by a groove in the core piece or from a thin plastic bridge or connection between the flanges.

Some embodiments of the invention have flanges that are curved or rolled in. This allows the flange edges to bond perfectly to the wallboard. The flanges cannot be rolled out or curved outward away from the wall, since this leads to flanges that will peel away from the wallboard and not bond properly.

DESCRIPTION OF THE DRAWINGS

The following illustrations provide examples of the principles of the present invention.

Several drawings and illustrations have been presented to aid in understanding the present invention. The scope of the present invention is not limited by what is shown in the figures.

DESCRIPTION OF THE INVENTION

The present invention relates to a wet-and-stick drywall corner trim material that allows an installer to take a pre-cut piece and stick it to the wall by means of its included adhesive material. The adhesive creates a permanent bond between the corner trim material and the drywall. Drywall mud or other mastic applied after the product installation can migrate through openings or holes in the flanges of the piece and bond to the wall, forming a very strong, damage resistant corner.

In a particular embodiment of the invention, the included adhesive may be of a type that is water activated. Such adhesives are known in the art. Any adhesive is within the scope of the present invention. The adhesive can be activated by wetting the adhesive coated surface of the piece prior to placing it onto the corner. The piece can be positioned perfectly while the adhesive is still wet. An alternative installation method can be to place the product dry onto the corner and then apply water to the outer surface. In this case, the water can pass through the pattern of holes in the flange and activate the adhesive which is already in position against the wall. As in the previous case, the piece can be moved and positioned while the adhesive is wet. It is preferred to use the first method to make sure every part of the adhesive surface is wet.

Figure 1:
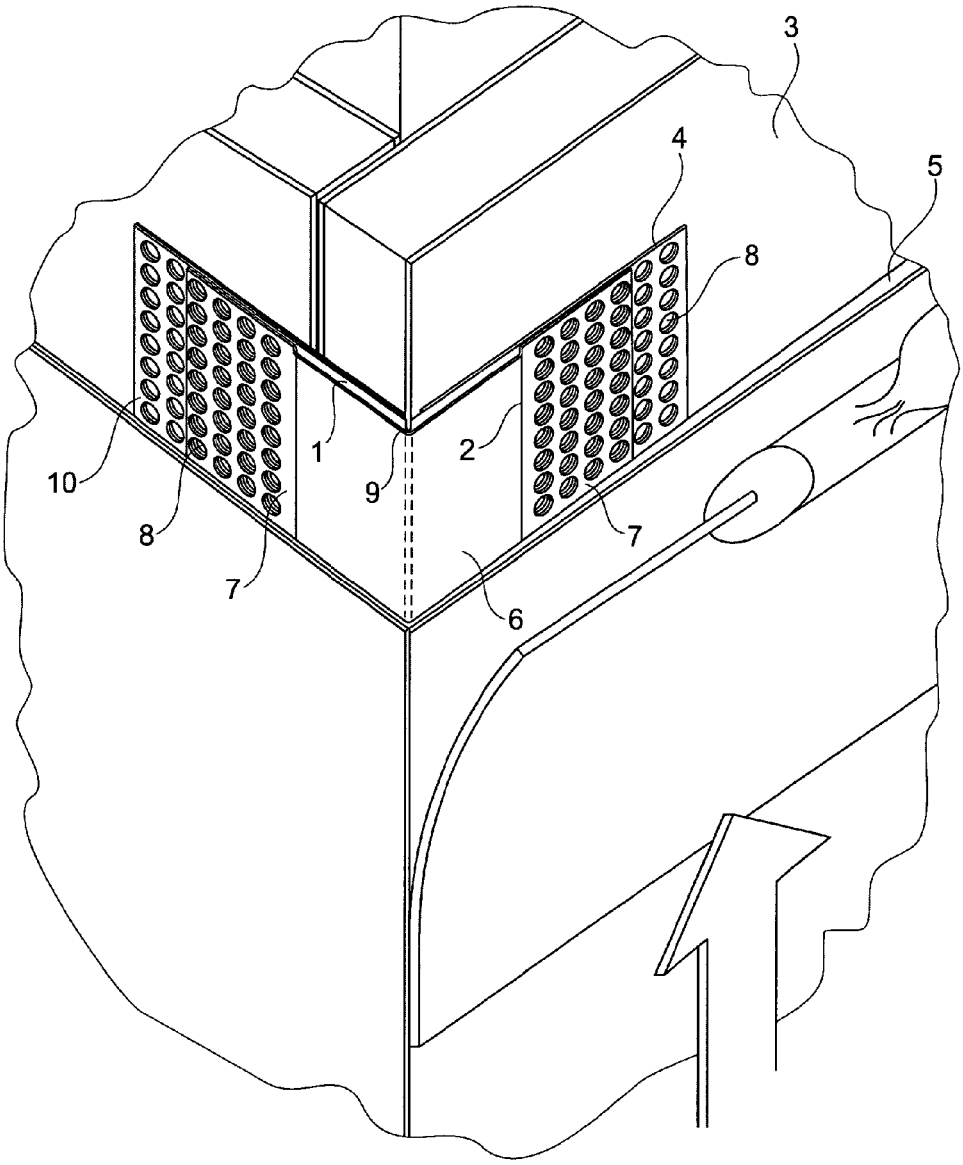
FIG. 1 shows a piece of adhesive material being installed.
Figure 9:
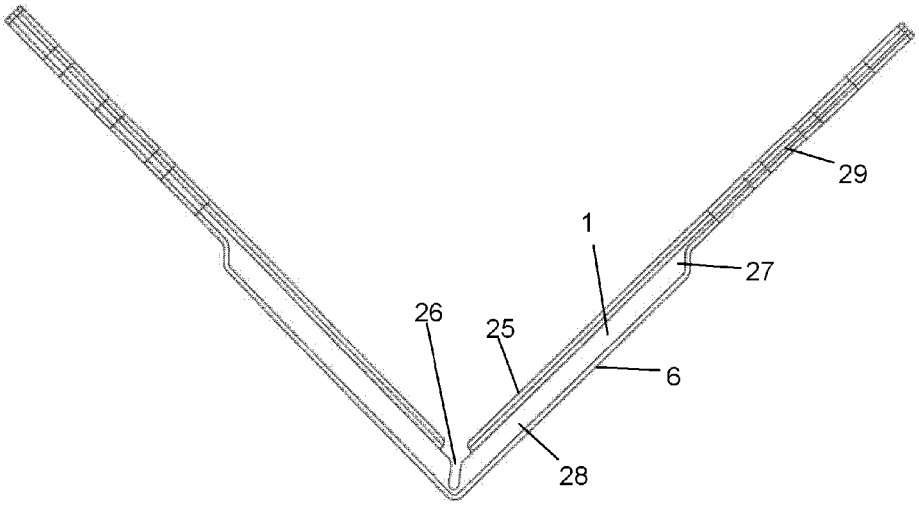
FIG. 9 shows an embodiment of the present invention with all layers terminating at the flange edge.

Turning to FIG. 1, an embodiment of the present invention is shown being installed on an exterior drywall corner. The drywall trim piece contains a core member 1 which can be extruded from high impact plastic or any other semi-rigid material. The outside of the piece can be formed or extruded into two flanges 7. The nose 9 can generally be separated from the flanges 7 by a step 2 on each side. This step 2 makes the piece boxable as previously described. The nose portion 9 and flanges 7 can optionally be covered with a layer of paper or other fibrous material 6. Each flange 7 can contain a series of perforations or holes 8 that allow the drywall mud 5 or other mastic to penetrate through the flange 7 to the drywall 3. The paper 6, if extended over the flange 7, can form a paper flap 10 and can also have perforations or holes 8 aligned with the holes in the flange 7. However, the preferred method is to have all the layers terminate together at the flange edge (as shown in FIG. 9). The wall facing side of the flanges 7 can be coated with an adhesive 4 that is preferably a water-activated adhesive (any adhesive may be used). A layer of paper can optionally be used between the adhesive layer 4 and the core 1. This paper layer and adhesive layer may extend beyond the edge of the flange 7 creating a paper flap and adhesive 10.

Figure 2:
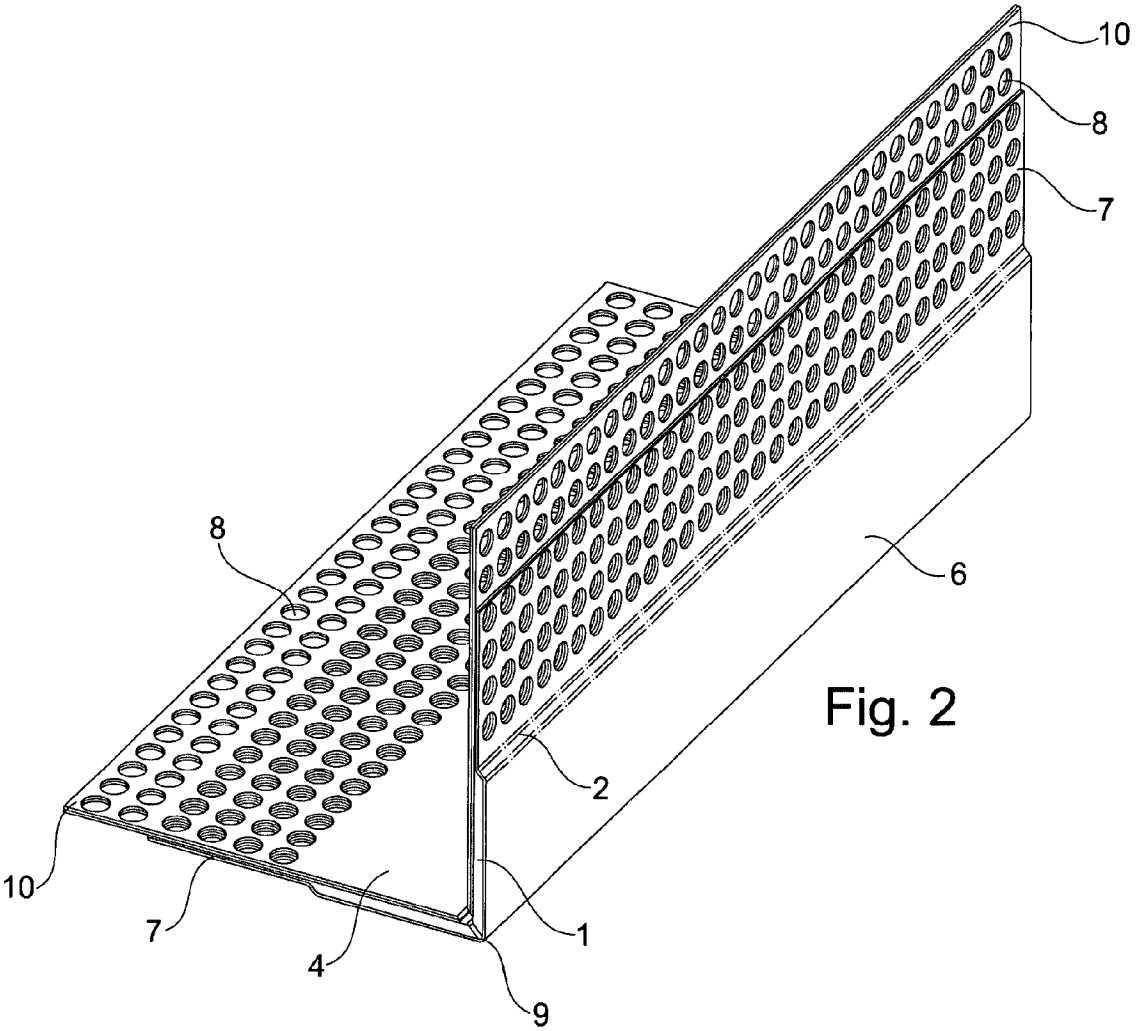
FIG. 2 shows a perspective view of an embodiment of the present invention.

FIG. 2 shows a perspective view of the embodiment of FIG. 1. The outside surface of the base core material 1 can be covered with paper 6. The flange 7 extends to a step 2 and then outward to its outer edge. The inside surface of the flange can be coated with an adhesive layer 4. Alternatively there may be an inner layer of paper 25 between the adhesive layer and the core material 1. Holes 8 can be placed on one or both flanges 7, in one or both the paper flaps 10, and the core material 1 parts of the flange to allow mud to penetrate from the outside or room facing surface of the corner trim material to the inside or wall facing surface.

Figure 3:
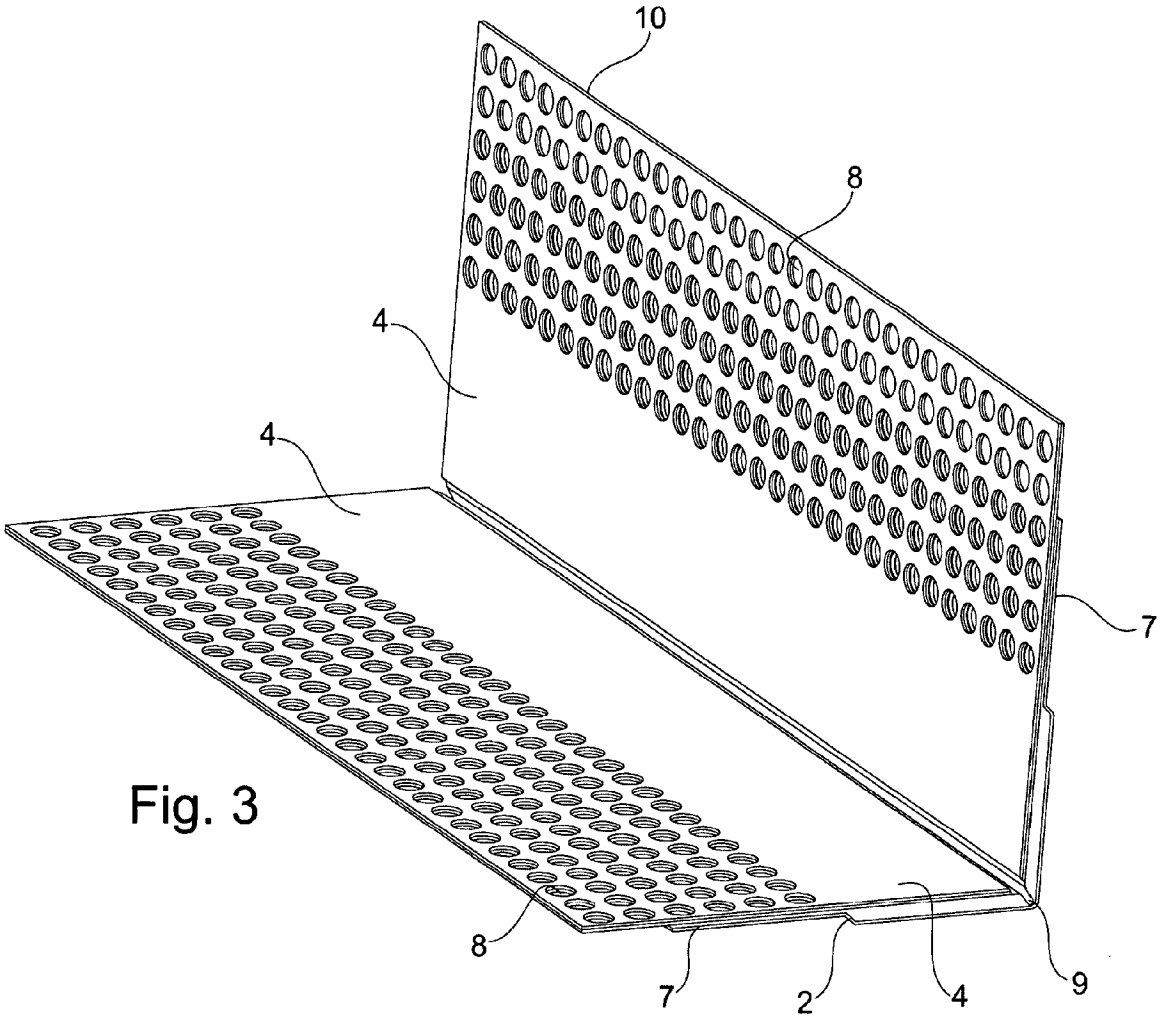
FIG. 3 shows the embodiment of FIG. 2 from a different direction.

FIG. 3 shows the same embodiment from a different perspective.

Figure 4:
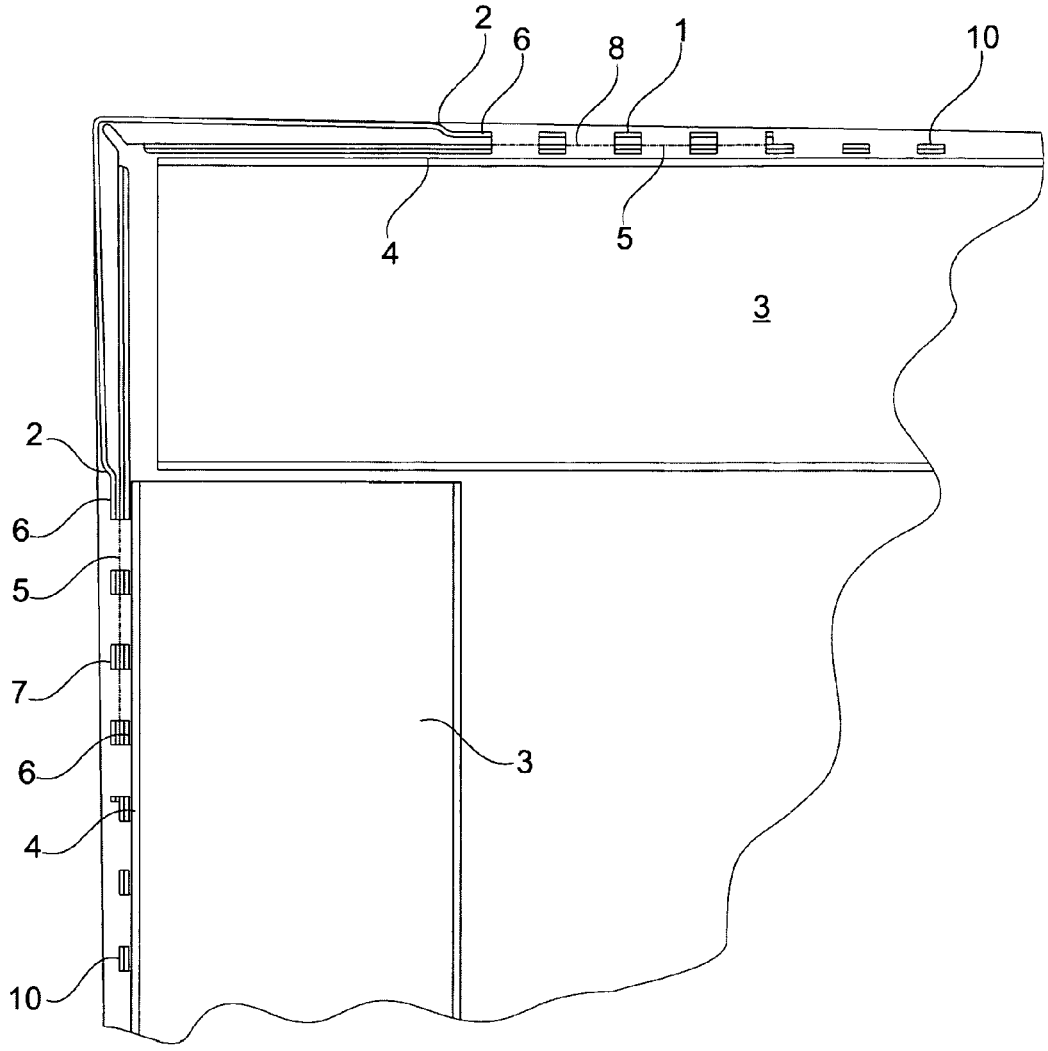
FIG. 4 shows a top down sectional view of a typical installation of an embodiment of the present invention.

FIG. 4 shows a cross-sectional view of the present invention installed on an exterior drywall corner. Mud or other mastic 5 is shown penetrating holes 8 in the flanges 7 and flange outer layer of paper 6 and the possible paper flap 10. An adhesive coating 4 is initially used to attach and hold the piece against the wallboard 3 as has been previously described. While the examples and embodiments shown in the figures are primarily directed to exterior corners, the principles of the invention can also be advantageously applied to interior corners or flexible trim pieces commonly used on inside off angles. All types of drywall corner trim materials are within the scope of the present invention. Steps 2 on each side can be seen that can be used to make the piece boxable (capable of being simultaneously wet mudded on each side).

Figure 5:
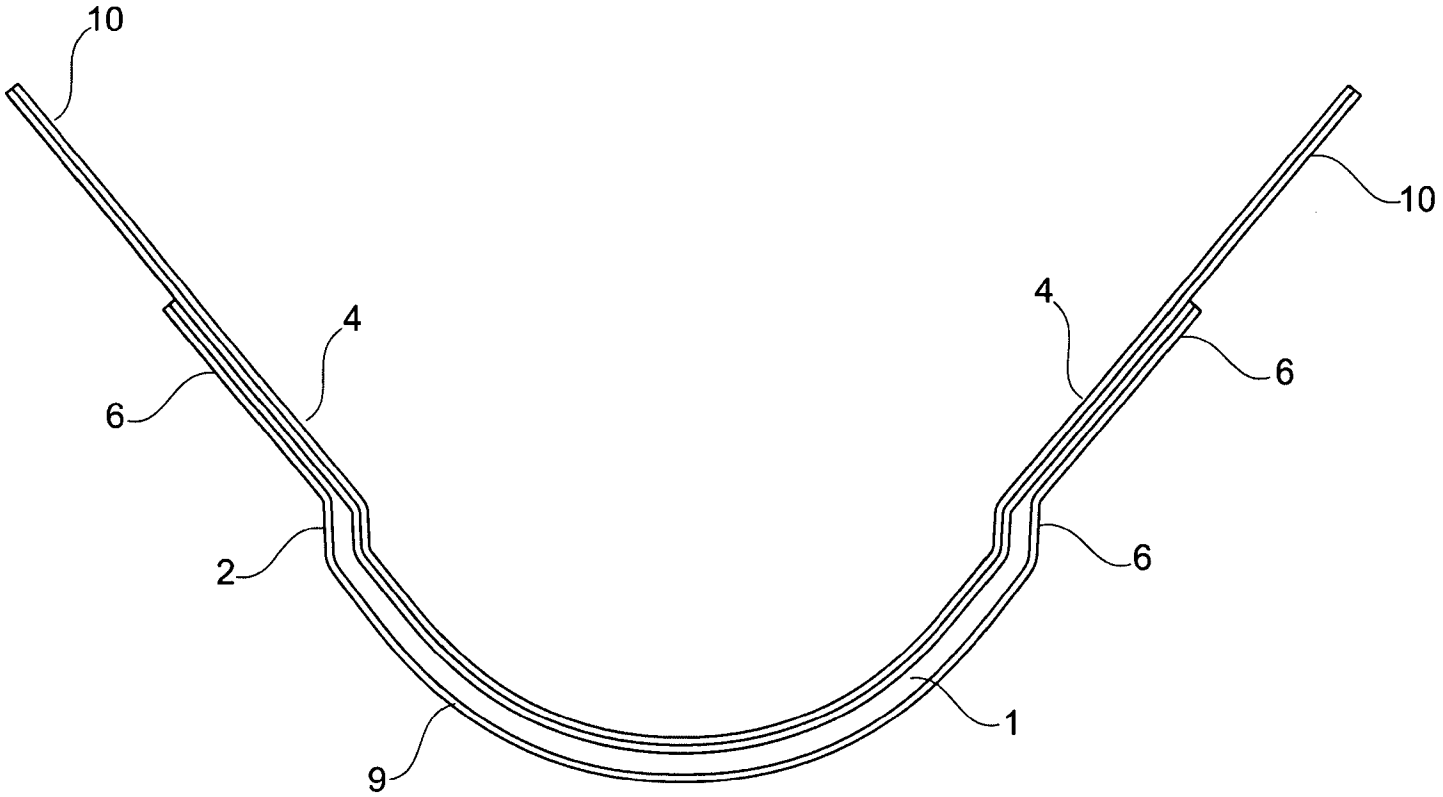
FIG. 5 shows an end view profile of a bullnose embodiment of the invention.
Figure 6:
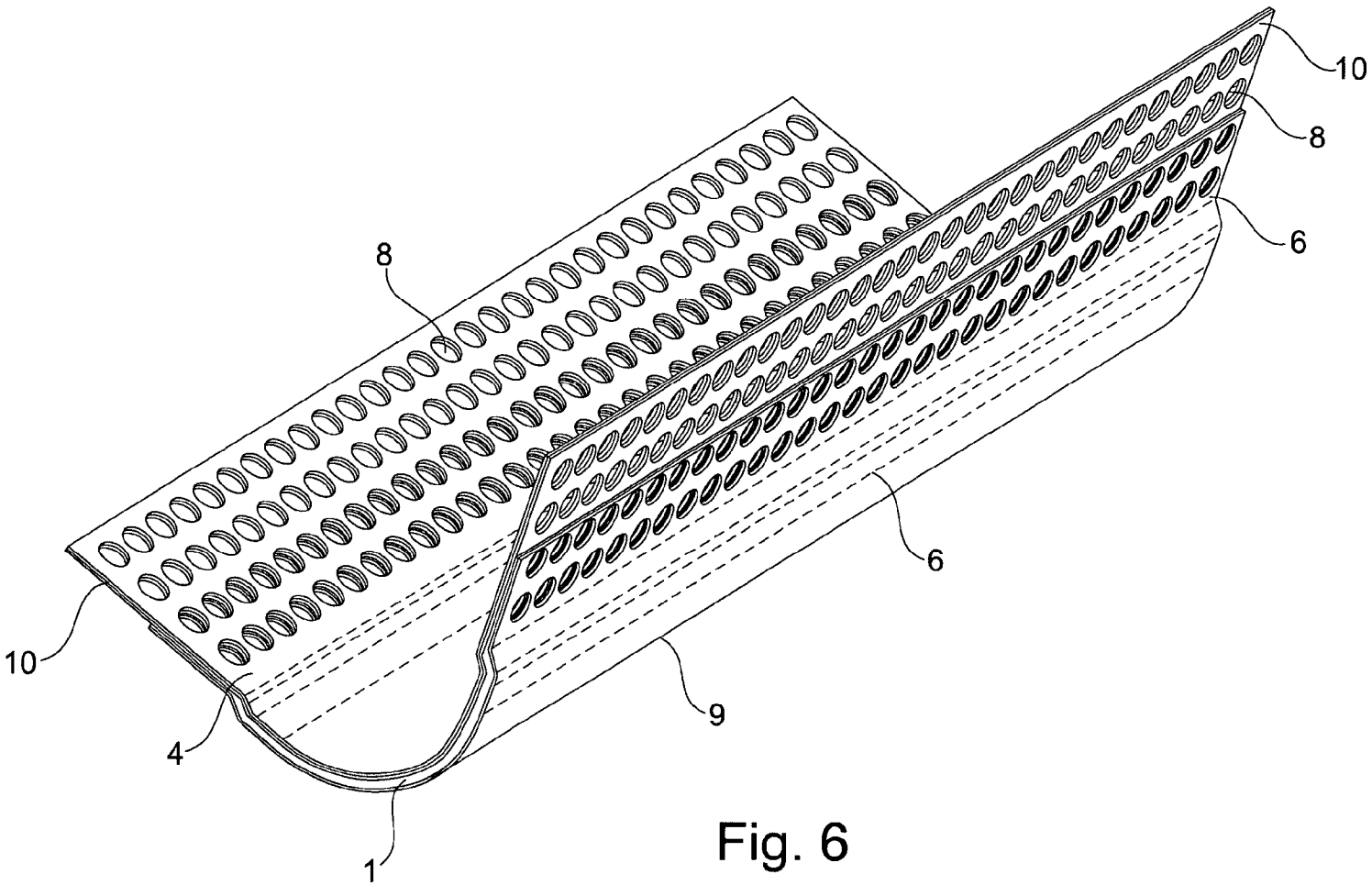
FIG. 6 shows a perspective view of the bullnose embodiment of FIG. 5.

FIG. 5 shows a bullnose embodiment of the present invention that works on the same principles as the standard nose model. In this case the semi-rigid core 1 and nose 9 are shaped in a large crown that form a bullnose known in the art. Again, an adhesive layer 4 can be seen on the wall-facing side of the piece and again, a paper layer 25 may be used between the adhesive 4 and core 1 and this paper and adhesive 4 can optionally extend beyond the edge of the flange 7 it creating a paper flap 10 with adhesive 4 in the wall facing side FIG. 6 shows a perspective view of the bullnose piece of FIG. 5. The crown bullnose 9 can be seen as well as the flanges 7 with penetrating holes 8 in the outer part of the flanges 7 as in the non-bullnose pieces. The adhesive layer 4 can be seen on the wall-facing side as in FIG. 5. Also shown are the room facing paper layer 6 and the paper layer 25 between the adhesive 4 and the core 7 creating a paper flap 10.

It should be noted that while standard nose trim pieces and bullnose trim pieces have been presented as examples, any type of nose or shape of the piece is within the scope of the present invention. As previously stated, the concepts and principles of the present invention can be used with any type of drywall corner or seam and in any application for exterior or interior corners bead or trim material. Any type of adhesive may be used.

In general, the trim piece can be a three-layer semi-rigid member including an outer, room facing fibrous material continuously laminated to a continuously extruded central semi rigid core material which is in turn continuously laminated to an inner, wall-facing coated fibrous material that can be coated with adhesive. The internal semi rigid core material can be high impact plastic or similar material. The piece can generally be made with a centerline that has a flexible hinge that can be bent and re-bent any number of times to any angle without the centerline distorting (while the centerline remains straight and true during and after numerous bendings).

Many installers will snap a straight line next to the corner in order to align a corner piece accurately, straight and square to the corner. The construction of the corner piece thickness of the present invention must be such that it will be loosely bonded to the corner immediately after installation, while it may still be moved without wrinkling the flanges or otherwise deforming the product. A flange that is too weak (such as a paper flap) will wrinkle or fold when the product is aligned or re-positioned to get a straight and square installation. A flange that is too stiff may not lay flat against the wall surface and/or delaminate when the product is aligned or re-positioned to get a straight and square installation. Therefore, one of the features of the present invention is a flange that is not too stiff to lay flat or too weak to be moved with the adhesive in the wet state. This is done by using a plastic flange that has no overhanging paper (plastic runs out to the edges). The flange thickness can be set at approximately 0.020" thick such that the flange is pliable enough to lay flat against the wall surface and bond to that surface with only the incorporated adhesive, while being rigid enough to be moved (slid along the corner length or side to side along the plane of the wall surface or otherwise re-positioned) to get the corner straight and positioned accurately on the corner being finished.

Water activated, or re-moistenable, adhesives are developed to have particular working times for particular usages. Working time (or open time) is defined as the amount of time an adhesive remains tacky before it sets to a solid bond that can no longer be moved or re-positioned. In the drywall industry this time is approximately 15 to 45 seconds depending on how much fluid (water) is applied to activate the adhesive. One such adhesive is a InterTape product S3 911 glue manufactured by Intertape Polymer Group in Menasha Wis. on a 90 lb bleach white paper. During this working time (or open time) the adhesive must still have a strong enough tack or peel strength to hold the corner piece in place over the corner being finished and strong enough to hold down the flanges of the corner piece in order to get a continuous bond between the corner piece and the wall corner being finished, and yet still be able to be moved or slid during final corner positioning to get a straight installation. It should also be noted that generally, water-activated adhesives swell when wetted; therefore, the adhesive layer generally needs to be thin.

In another embodiment of the present invention, an expanding or swelling adhesive may be used. That is an adhesive that will swell, or expand in volume, when activated. One method of achieving this is to use sodium bicarbonate and activating it with water and vinegar (acetic acid) that created gas pockets (foams up) when the adhesive is activated with water. Another method is to use Super Absorbent Polymers (SAP) that absorb water rapidly, swelling the adhesive. Some Super Absorbent Polymers available today include Norsocryl XFS and LiquiBlock HS both manufactured by Creative Chemistry of Greensboro, N.C.

The reason for wanting an expanding adhesive is to create an adhesive with a volume more like standard joint compound (mud) when activated which will allow good re-positionability and will fill any spaces (nail dimples, joints between boards, etc) during installation.

Finally, since many water-activated adhesives look about the same wet or dry to the naked eye, it is advantageous to have a way for the installer to tell that he has applied water to all parts of the adhesive layer (no dry spots). This can be accomplished in an embodiment of the present invention by mixing a coloring material with the dry adhesive. This coloring material should change color (or become darker or more intense) when wet. One such coloring material is standard food coloring known in the art. There are also hydro-chromatic agents known in the art that change color when wetted.

Figure 7A:
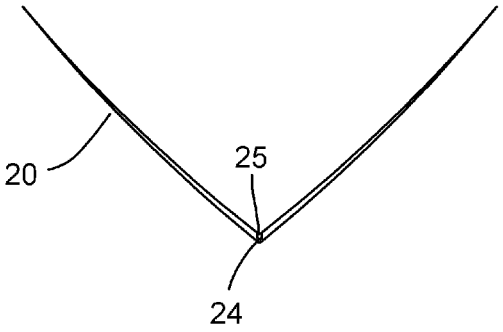
FIGS. 7A-7B shows an embodiment of the invention with slightly curved flanges.
Figure 7B:
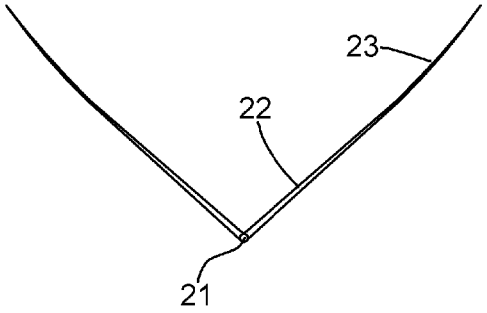

FIGS. 7A-7B show embodiments of the present invention with flanges that are curved in or rolled in. FIG. 7A shows flanges 20 that, before they are bonded, curve along their length. It also shows a room-facing apex 24 and a groove hinge 25 running end-to-end that allows the piece to flex to any angle repeatably a very large number of times since it is typically high-impact plastic. FIG. 7B shows flanges that, before they are bonded, are straight 22 out to a point along the flange and then begin to bend inward 23. Causing the flanges to curve slightly inward, or toward the wall surface, leads to perfect bonding of the flange edge to the adjacent wallboard. If a flange curves even slightly outward, it will not bond correctly and may peel away from the wallboard. A fixed room-facing apex 21 can run end-to-end along the piece.

Figure 8:
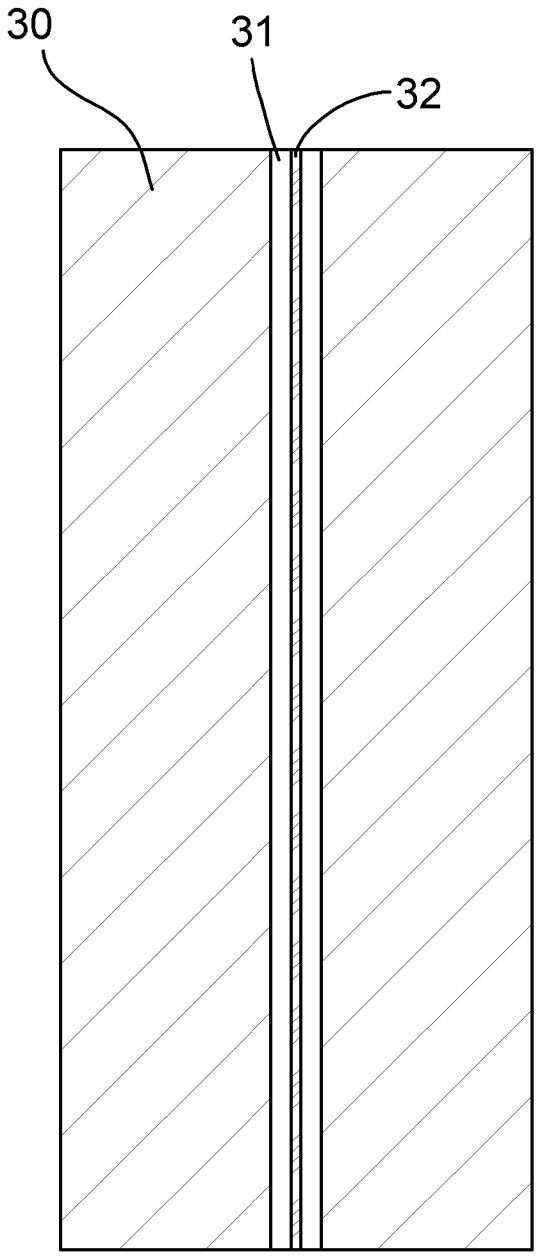
FIG. 8 shows an embodiment of the invention with paper split along the centerline.

FIG. 8. shows a side view of an embodiment of the present invention that has a groove hinge 32 running end-to-end along the centerline between the flanges 30 and a region 31 near the groove 32 where there is no paper. This region can be small and close to the centerline to allow the flanges to assume any angle and still have the paper layers and adhesive layers and the core material match up.

FIG. 9 shows an embodiment of the present invention where all of the layers terminate together at the outer edge of the flange. The core layer 1 has a step 27 from a thicker region 28 to a thinner region 29 toward the flange edge. An inner layer of paper 25 can be coated with adhesive and run from almost the center of the piece to the outer flange edge. An outer paper layer can 6 can run over the entire room-facing surface of the piece. An end-to-end notch or groove 26 can act as a hinge allowing the piece to assume any acute angle to fit an exterior corner. Holes (shown in FIG. 10) can penetrate the outer part of each flange. While not visible in FIG. 9, the flanges can curve slightly inward to assure a perfect bond as previously described (this can be seen in FIGS. 7A and 7B). Also, as previously described, a paper flap may wrinkle or fold during final positioning, and/or blisters (air pockets) may form between a paper flap and the wallboard if the paper flap is too pliable.

Figure 10:
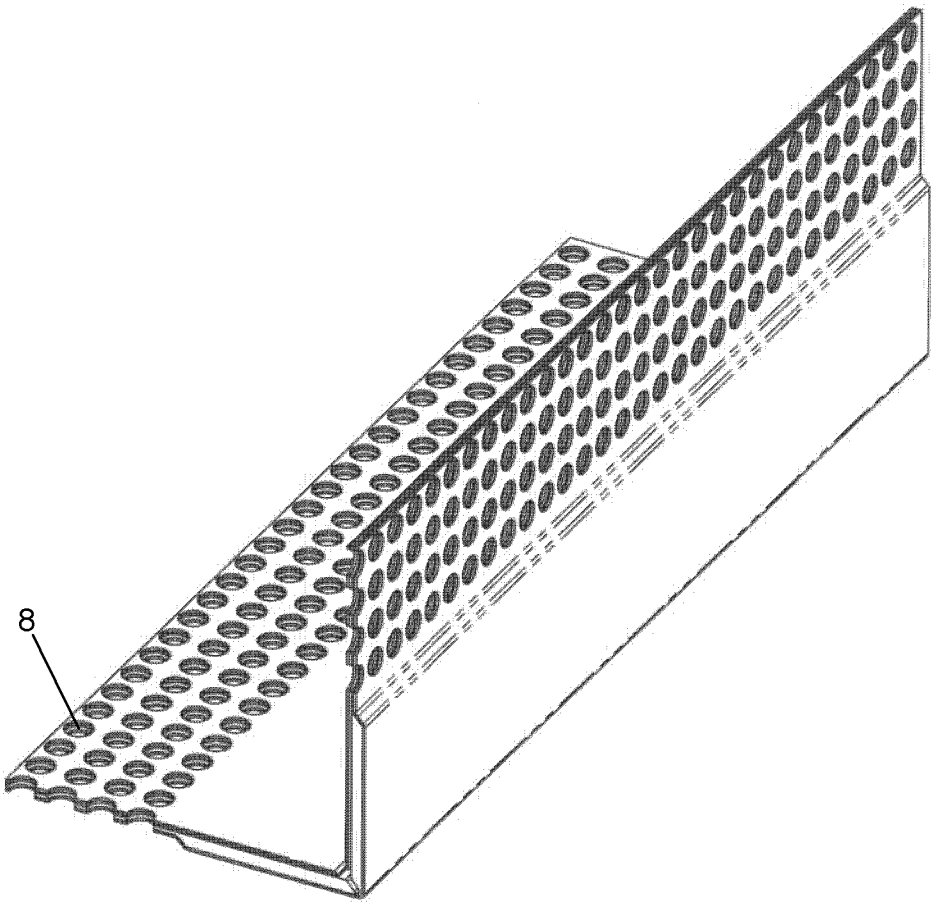
FIG. 10 is a different perspective of the embodiment of FIG. 2.

FIG. 10 shows a perspective view of the embodiment of FIG. 9. Here, the holes 8 can be clearly seen.

Several descriptions and illustrations have been presented to aid in the understanding of the present invention. One of skill in the art will recognize that numerous changes and variations are possible without departing from the spirit of the invention. Each of these changes and variations is within the scope of the present invention.

I claim:

1. A drywall corner piece comprising:

a continuously extruded, laminated, three-layer construction with an elongated semi-rigid member having two flanges extending from a centerline to flange edges, said flanges forming an acute angle about said centerline and having a room-facing side and a wall-facing side;

each of said flanges having an arcuate portion with a radius of curvature facing toward the wall-facing side, each flange comprises a flat portion that extends between the centerline and a respective one of the arcuate portions, and the radius of curvature of each flange extends from the flat portion to a respective one of the flange edges;

the three-layer construction comprising an outer, room-facing fibrous material continuously laminated to the elongated semi-rigid member, and an inner, wall-facing fibrous material also continuously laminated to the elongated semi-rigid member; and the inner, wall-facing fibrous material being continuously coated with a water-activated adhesive.

2. The drywall corner piece of claim 1 further comprising a plurality of holes through portions of said flanges and through at least one of the two fibrous materials, away from the centerline.

3. The drywall corner piece of claim 1 wherein said inner, wall-facing fibrous material is split along said centerline.

4. The drywall corner piece of claim 1 wherein said elongated, semi-rigid member transitions in thickness from thicker nearer said centerline to thinner near said flange edges at a step located between said centerline and the flange edges.

5. The drywall corner piece of claim 1 further comprising a groove running end-to-end along said centerline, wherein said groove acts as a hinge allowing said drywall corner piece to be repeatably bent to any acute angle, and all three layers of the three-layer construction terminate at the flange edges.

6. The drywall corner piece of claim 1 wherein said water-activated adhesive changes color when wetted, and a plurality of holes through portions of all three layers of said three-layer construction, away from the centerline.

7. The drywall corner piece of claim 1 further comprising a non-flexible, room-facing apex running end-to-end along said centerline.

8. A drywall corner piece comprising:

a continuously extruded, laminated, three-layer construction with an elongated semi-rigid member having two flanges extending from a centerline to flange edges, said flanges forming an acute angle about said centerline;

each of said flanges having an arcuate portion with a radius of curvature facing toward the wall-facing side, each flange comprises a flat portion that extends between the centerline and a respective one of the arcuate portions, and the radius of curvature of each flange extends from the flat portion to a respective one of the flange edges;

the three-layer construction comprising an outer, room-facing fibrous material continuously laminated to the elongated semi-rigid member, and an inner, wall-facing fibrous material also continuously laminated to the elongated semi-rigid member;

wherein said elongated semi-rigid member transitions in thickness from an inner thicker region nearer said centerline to an outer thinner region near said flange edges at a step located between said centerline and the flange edges;

a plurality of holes through said flanges in said outer thinner region;

a groove running end-to-end along said centerline, wherein said groove acts as a hinge allowing said drywall corner piece to be repeatably bent to any acute angle; and the inner fibrous material being continuously coated with a water-activated adhesive.

9. The drywall corner piece of claim 8 wherein said water-activated adhesive changes color when wetted, and all three layers of the three-layer construction terminate at the flange edges.

10. The drywall corner piece of claim 8 wherein said inner, wall-facing fibrous material is split along said centerline, and the plurality of holes extends through portions of all three layers of said three-layer construction, away from the centerline.

11. The drywall corner piece of claim 9 wherein said inner, wall-facing fibrous material is split along said centerline, and each arcuate portion comprises an entirety of a respective one of the flanges, such that the radius of curvature extends from the about centerline to about a respective one of the flange edges.

12. The drywall corner piece of claim 11 wherein said inner, wall-facing fibrous material is split along said centerline.

13. A drywall corner piece comprising:

a continuously extruded, laminated, three-layer construction with an elongated semi-rigid member having two flanges extending from a centerline to flange edges, said flanges forming an acute angle about said centerline;

each of said flanges having arcuate portion with a radius of curvature facing toward the wall-facing side, and each arcuate portion comprises an entirety of a respective one of the flanges, such that the radius of curvature of each flange extends from about the centerline to about a respective one of the flange edges;

the three-layer construction comprising an outer, room-facing fibrous material continuously laminated to the elongated semi-rigid core member, and an inner, wall-facing fibrous material also continuously laminated to the elongated semi-rigid member, and all three layers of the three-layer construction terminate at the flange edges;

wherein said elongated semi-rigid member transitions in thickness from an inner thicker region nearer said centerline to an outer thinner region near said flange edges at a step located between said centerline and the flange edges;

a plurality of holes through said flanges in said outer thinner region;

a non-flexible, room-facing apex running end-to-end along said centerline;

the inner, wall-facing fibrous material being continuously coated with a water-activated adhesive.

14. The drywall corner piece of claim 13 wherein said water-activated adhesive changes color when wetted, and the plurality of holes also extends through at least one of the two fibrous materials.

15. The drywall corner piece of claim 13 wherein said flange edges are approximately 0.02 inches thick, and the plurality of holes also extends through both of the two fibrous materials.

* * * * *